United States Patent [19]

Soeters, Jr.

[11] Patent Number: 4,768,934

[45] Date of Patent: Sep. 6, 1988

[54] PORT ARRANGEMENT FOR ROTARY POSITIVE DISPLACEMENT BLOWER

[75] Inventor: Raymond A. Soeters, Jr., Farmington Hills, Mich.

[73] Assignee: Eaton Corporation, Cleveland, Ohio

[21] Appl. No.: 799,760

[22] Filed: Nov. 18, 1985

[51] Int. Cl.[4] ..... F04C 18/16

[52] U.S. Cl. ..... 418/1; 418/15; 418/78; 418/201

[58] Field of Search ..... 418/1, 15, 78, 201, 418/206

[56] References Cited

U.S. PATENT DOCUMENTS

| | | | |
|---|---|---|---|
| 1,746,885 | 2/1930 | Bunge et al. | 418/206 |
| 2,014,932 | 9/1935 | Hallett | 418/83 |
| 2,028,414 | 1/1936 | Schneider | 230/141 |
| 2,078,334 | 4/1937 | Martocello | 418/203 |
| 2,259,027 | 10/1941 | De Zarate et al. | 418/206 |
| 2,448,901 | 8/1943 | McCulloch et al. | 418/206 |
| 2,454,048 | 11/1948 | Flanagan | 230/141 |
| 2,463,080 | 2/1945 | Beier | 418/206 |
| 2,480,818 | 8/1949 | Whitfield | 103/128 |
| 2,906,448 | 8/1959 | Lorenz | 230/210 |
| 3,058,652 | 10/1962 | Glamann | 230/138 |
| 3,121,529 | 2/1964 | Hubrich | 418/203 |
| 3,531,227 | 9/1970 | Weatherston | 418/94 |
| 3,667,874 | 6/1972 | Weatherston et al. | 418/9 |
| 3,844,695 | 10/1974 | Weatherston | 418/180 |
| 4,042,062 | 8/1977 | Tooley | 181/36 |
| 4,135,602 | 1/1979 | Clark | 181/230 |
| 4,215,977 | 8/1980 | Weatherston | 418/1 |
| 4,556,373 | 12/1985 | Soeters | 418/75 |
| 4,560,333 | 12/1985 | Fujiwara | 418/180 |
| 4,643,655 | 2/1987 | Uthoff | 418/206 |

OTHER PUBLICATIONS

Uthoff, L. H. and John W. Yakimow, "Development of the Eaton Supercharger", SAE Technical Paper Series, Feb., 1987.

*Primary Examiner*—Carlton R. Croyle
*Assistant Examiner*—T. W. Olds
*Attorney, Agent, or Firm*—P. S. Rulon

[57] ABSTRACT

An improved rotory positive displacement blower (10) of the Roots-type with reduced airborne noise and superior efficiency. The blower includes a housing (12) defining generally cylindrical chambers (32, 34) having cylindrical wall surfaces (20*a*, 20*b*) and containing meshed lobed rotors (14, 16) having the lobes (14*a*, 14*b*, 14*c*, 16*a*, 16*b*, 16*c*) thereon formed with an end-to-end helical twist according to the relation 360°/2n, where n equals the number of lobes per rotor. Preferably, n equals three. The blower housing (12) also defines inlet and outlet ports (36, 38) and the intersections of wall surfaces (20*a*, 20*b*) define a cusp (20*d*) associated with the inlet port (36) and a cusp (20*e*) associated with outlet port (38). The inlet and outlet port openings are skewed in opposite directions to increase the time the top lands of the lobes are in sealing relation with cylindrical walls (20*a*, 20*b*) of chambers (32, 34). Transverse boundaries (20*g*, 20*i*) of the inlet port are traversed by the lobes prior to traversal of the inlet port cusp (20*d*) by trailing ends (14*h*, 16*h*) of the lobes. In a similar manner, the transverse boundaries (20*n*, 20*r*) of the outlet port are traversed by the lobes subsequent to traversal of the outlet port cusp (20*e*) by leading ends (14*g*, 16*g*) of the lobes. Elongated backflow slots (40, 42) having a length/width ratio of at least four are disposed on opposite sides of the outlet port cusp and substantially parallel to the traversing lobes of the associated rotor. The backflow slots are traversed by the lobes prior to traversal of cusp (20*e*) and outlet port boundaries (20*n*, 20*r*) by the lobes.

23 Claims, 4 Drawing Sheets

FIG. 2.
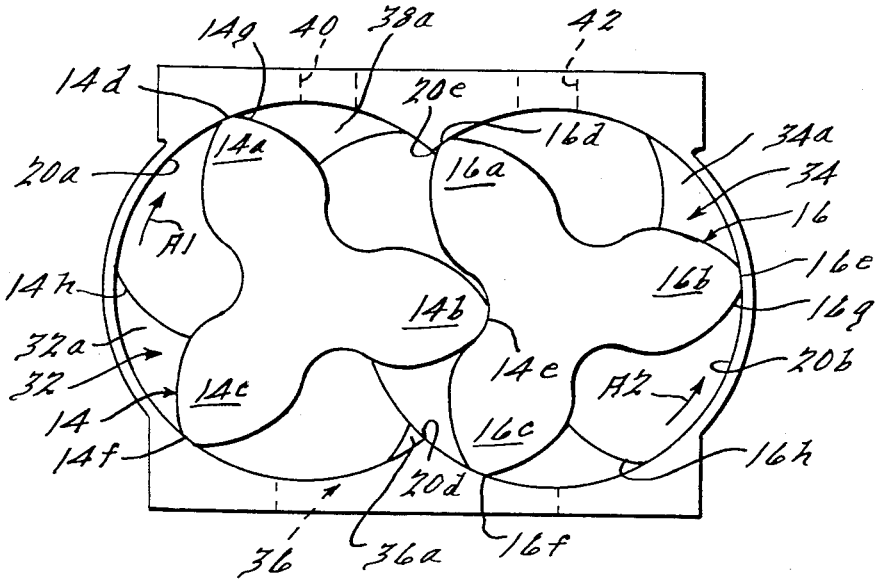
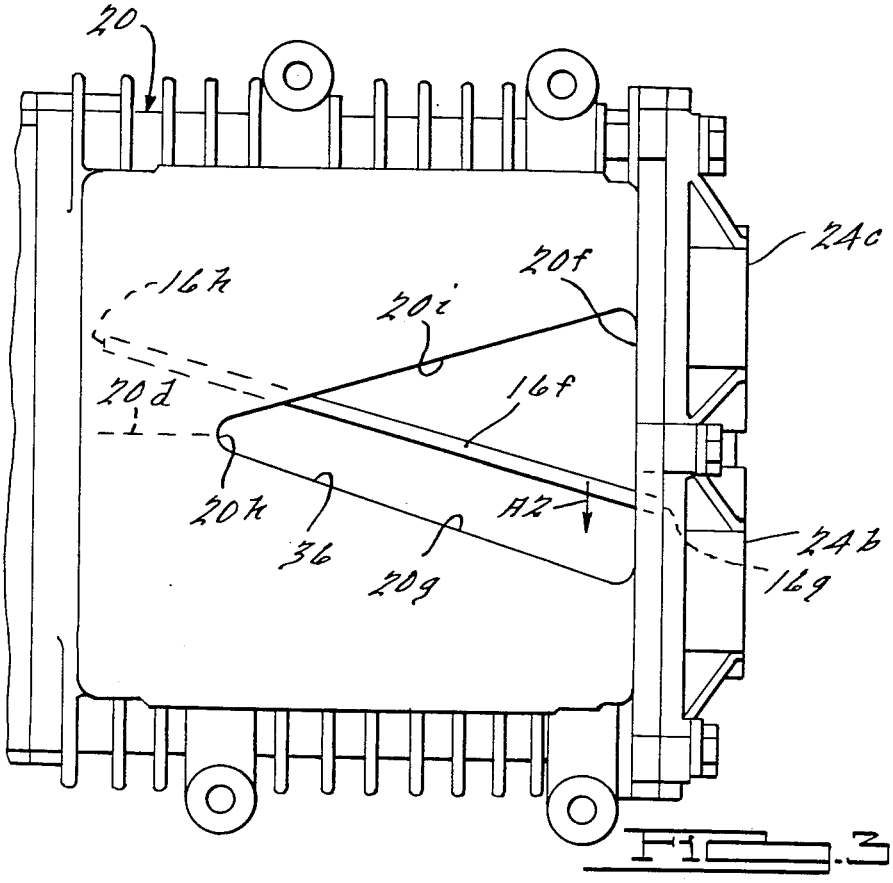
FIG. 3.

FIG. 4.
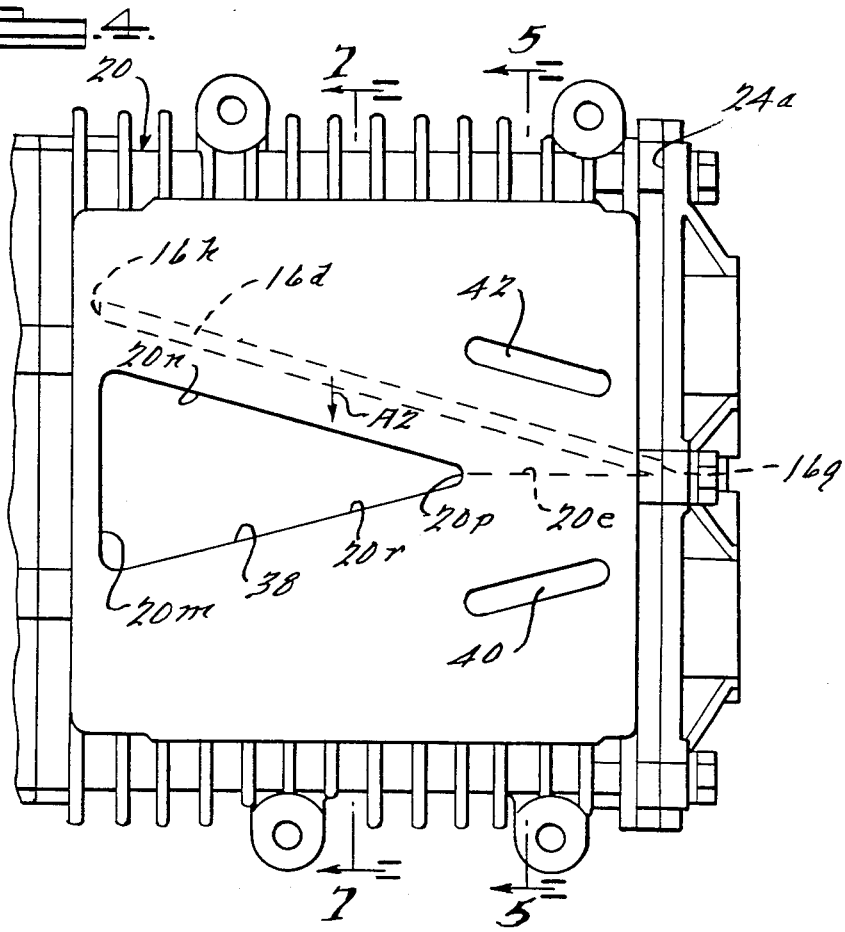
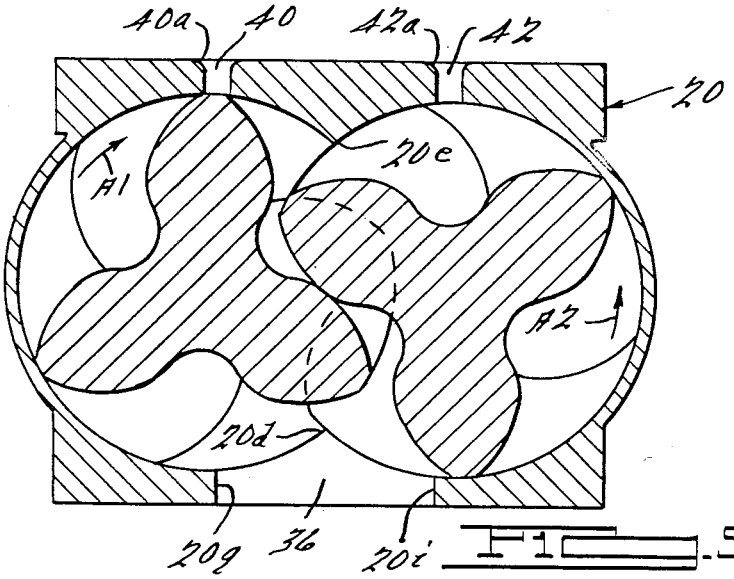
FIG. 5.

Fig. 6.
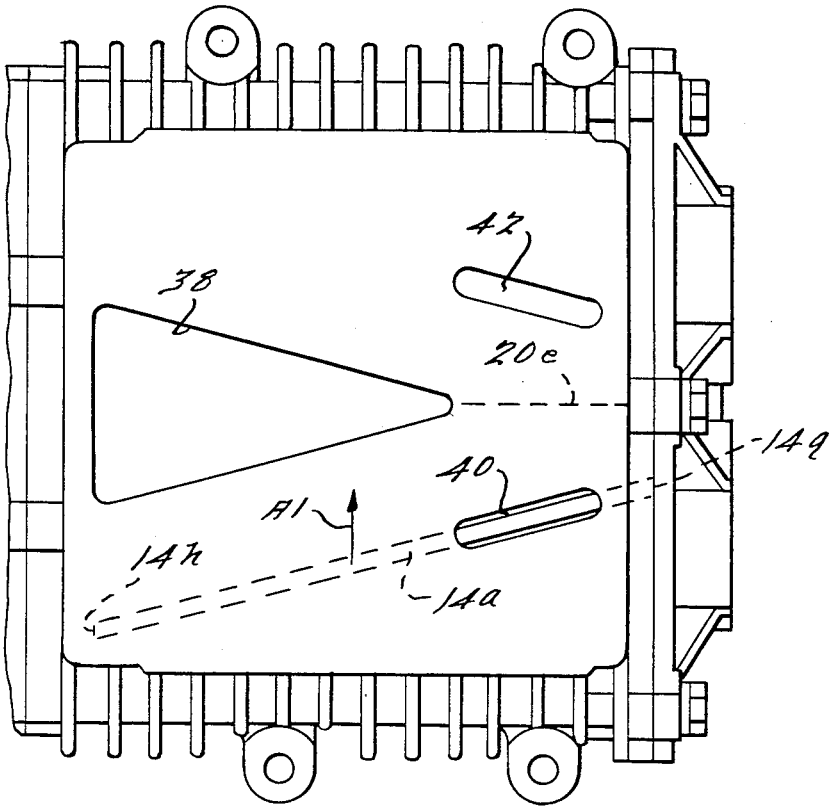
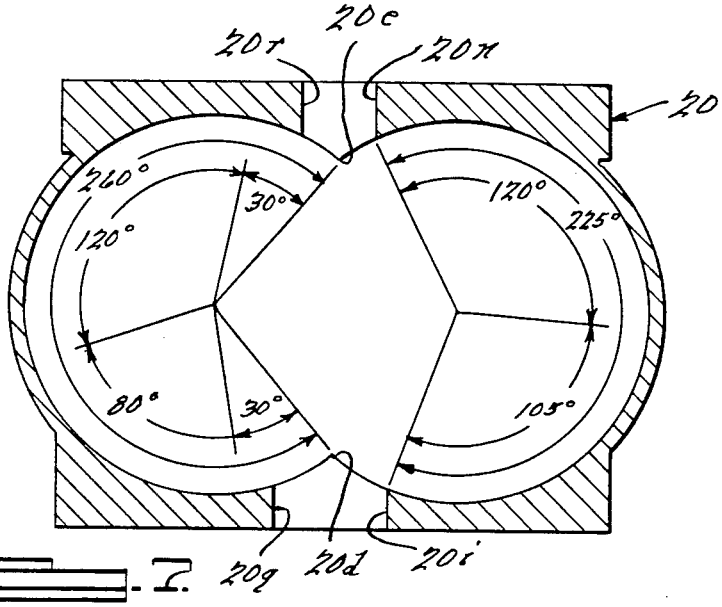
Fig. 7.

PORT ARRANGEMENT FOR ROTARY POSITIVE DISPLACEMENT BLOWER

CROSS-REFERENCE TO RELATED APPLICATION

This application relates to U.S. Application Ser. No. 652,536, filed 9-20-84, assigned to the assignee of this application, and incorporated herein by reference, now U.S. Pat. No. 4,609,335.

BACKGROUND OF THE INVENTION

1. Field Of The Invention

This invention relates to rotary, positive displacement blowers of the backflow type. More specifically, the present invention relates to reducing noise and/or improving efficiency of a Roots-type blower employed as a supercharger for an internal combusion engine.

2. Description Of The Prior Art

Rotary blowers of the Roots-type have long been characterized by noisy and/or inefficient operation. Attempts to decrease the source of the noise have generally decreased efficiency. The blower noise may be roughly classified into two groups: solid-borne noise caused by rotation of timing gears and rotor shaft bearings subjected to fluctuating loads, and fluid-borne noise caused by fluid flow characteristics such as rapid changes in fluid velocity and pressure. Rapid fluctuations in fluid flow and pressure also contribute to solid-borne noise.

As is well known, Roots-type blowers are similar to gear-type pumps in that both employ toothed or lobed rotors meshingly disposed in transversely overlapping cylindrical chambers and in that both transfer volumes of fluid from an inlet port to an outlet port via spaces between unmeshed teeth or lobes of each rotor without mechanical compression of the fluid. In both the Roots and gear devices, the top lands and ends of the unmeshed teeth or lobes of each rotor are closely spaced from the inner surfaces of the cylindrical chamber to effect a sealing cooperation therebetween. Since gear pumps are used almost exclusively to pump or transfer volumes of lubricious fluids, such as oil, the meshing teeth therein may contact to form a seal between the inlet and outlet ports. On the other hand, since Roots-type blowers are used almost exclusively to pump or transfer volumes of nonlubricious fluid, such as air, timing gears are used to maintain the meshing lobes in closely spaced, non-contacting relation to form the seal between the inlet and outlet ports.

This sealing arrangement between the meshing lobes, and between the lobes and cylindrical chamber surfaces makes a Roots-type blower substantially more prone to internal leakage than a gear pump. The liquid of a gear pump is substantially more viscous than the air of a Roots-type blower; therefore, oil is more leak-resistant. At any given time, a gear pump has several teeth per rotor in sealing relation with the cylindrical chamber surfaces which form a very effective labyrinth seal, whereas a Roots-type blower often has only one lobe per rotor in such sealing relation. Accordingly, Roots-type blowers are prone to internal leakage. The leakage, as a precentage of total displacement, increases with increasing boost pressure or pressure ratio and increases with decreasing speed of the rotors.

As previously mentioned, the transfer volumes of air trapped between the adjacent unmeshed lobes of each rotor are not mechanically compressed. Air, of course, is a compressible fluid. Accordingly, if the boost or outlet port air pressure is greater than the air pressure in the transfer volumes, outlet port air rushes or backflows into the transfer volumes as they move into direct communication with the outlet port with resultant rapid fluctuations in fluid volocity and pressure. Such fluctuations, due to backflow, are known major sources of airborne noise. In general, the noise increases with increasing pressure ratio and rotor speed.

Other major sources of airborne noise are cyclic variations in volumetric displacement of the blower due to meshing geometry of the lobes, and outlet air which is abruptly trapped between the remeshing lobes and abruptly returned to the inlet port. When a Roots-type blower is employed as a supercharger to boost the air or air/fuel charge of an internal combustion engine in a land vehicle, such as a passenger car, the blower is required to operate over wide speed and pressure ranges; for example, speed ranges of 2,000 to 16,000 RPM and pressure ratios of 1:1 to 1:1.8 are not uncommon. Prior art efforts to cost-effectively reduce or eliminate airborne noise from Roots-type blowers in such supercharger applications have, at best, met with limited success. In general, the efforts have successfully reduced airborne noise only for limited operating conditions of the blower, i.e., for specific boost pressure and rotor speed combinations. For example, a concept may effectively reduce airborne noise by reducing rapid fluctuations in fluid velocity and pressure at a high rotor speed and a high boost pressure; however, the concept is often totally ineffective at low rotor speed and high boost pressure. Further, in many cases, the efforts have increased internal leakage of the blower and, thereby, have decreased volumetric efficiency of the blower, have decreased energy efficiency, have undesirably increased the temperature of the boosted air, and have undesirably required an increase in blower size and/or speed.

U.S. Pat. No. 2,014,932 to Hallett addresses the problem of airborne noise; therein Hallett teaches that non-uniform displacement, due to meshing geometry, is reduced by employing helical twist lobes in lieu of straight lobes. Hallett asserts that helical lobed rotors, each having three lobes circumferentially spaced 120° apart with a 60° helical twist, best effects a compromise between the requirements of maximum displacement for a blower of given dimensions and a maximum frequency of pulsations of lesser magnitude. Theoretically, such helically twisted lobes would provide uniform displacement were it not for cyclic backflow and air trapped between the remeshing lobes.

Hallett also addresses the backflow problem and proposes reducing the initial rate of backflow to reduce the instantaneous magnitude of the backflow pulses. This is done by mismatched or rectangular-shaped inlet and output ports each having two sides parallel to the rotor axes and, therefore, skewed relative to the traversing top lands of the helical lobes. The parallel sides of the ports are positioned such that the cylindrical surface of each rotor chamber is a 180° arc. With this lobe-port configuration, the lead lobe of each transfer volume traverses its associated outlet port boundary (i.e., the parallel sides) just as the trailing lobe of the transfer volume moves into sealing relation with the cylindrical wall surface; such an arrangement maximizes the time the trailing lobe is exposed to boosted or increased differential pressure and, thereby, maximizes the time for and rate of leakage across the trailing lobes.

Several other prior art patents also address the backflow problem by preflowing outlet port air into the transfer volumes before the top lands of the leading lobe of each transfer volume traverses the outer boundary of the outlet port. In some of these patents, as disclosed in U.S. Pat. No. 8,121,529 to Hubrich, preflow is provided by passages through the housing's cylindrical walls which sealingly cooperate with the top lands of the lobes. In U.S. Pat. No. 4,215,977 to Weatherston, preflow is provided in a manner similar to that of Hubrich. In a second embodiment of Wheatherston, preflow is provided by accurate channels or slots formed in the inner surfaces of the cylindrical walls which sealingly cooperate with the top lands of the lobes. The preflow arrangements of Hubrich and Weatherston, as with the backflow arrangement of Hallett, expose the trailing lobes of each transfer volume to boosted or increased pressure differential just as the trailing lobes move into sealing cooperation with the cylindrical wall surfaces and thereby undesirably maximize the time for and rate of leakage across the trailing lobes.

SUMMARY OF THE INVENTION

An object of this invention is to provide a rotary blower of the backflow type for compressible fluids which is relatively free of airborne noise and yet is high in volumetric efficiency.

According to a feature of the present invention, a rotary blower of the backflow type includes a housing defining two parallel, transversely overlapping, cylindrical chambers having internal cylindrical and end wall surfaces with the axes of the cylindrical chambers defining a longitudinal direction, with the end walls defining a transverse direction, and with each intersection of the cylindrical wall surfaces defining a cusp extending in the longitudinal direction; an inlet port and an outlet port having longitudinal and transverse boundaries defined on opposite sides of the chamber with the transverse boundaries of each port disposed on opposite sides of a plane extending longitudinally through the cusps; meshed, lobed rotors rotatably disposed in the chambers, the ends of the rotors and lobes sealingly cooperating with the end wall surfaces, the lobes of each rotor having top lands sealingly cooperating wth the cylindrical wall surfaces of the associated chamber and operative to traverse the port boundaries disposed on the associated side of the plane for effecting transfer of volumes of compressible inlet port fluid to the outlet port via spaces between adjacent unmeshed lobes of each rotor, and the volume of each transfer volume remaining constant while the top lands of the leading and trailing lobes of each transfer volume are disposed between the associated boundaries of the inlet and outlet ports; the improvement comprising an elongated backflow ports extending through a portion of the housing wall of each cylindrical chamber, the backflow ports being transversely spaced from each other on opposite sides of the plane, both backflow ports being on the outlet port side of the housing and both being structurally separated from the inlet and outlet ports by portions of the cylindrical wall surfaces, each backflow port traversed by the top land of the lead lobe of the associated upcoming transfer volume and providing a restricted passage for communicating outlet port fluid to each upcoming transfer volume prior to traversal of the associated outlet port boundaries by the top land of the lead lobe and prior to traversal of the cusp associated with the outlet port side of the housing, and each backflow port having a length/width ratio of at least four with the lengthwise direction of each backflow port being disposed substantially parallel to the traversing top land to facilitate rapid full opening of the backflow ports.

According to another feature of the invention, a method of reducing airborne noise and improving volumetric efficiency of a Roots-type blower including a housing defining two parallel, transversely overlapping cylindrical chambers having cylindrical and end wall surfaces with each intersection of the cylindrical wall surfaces defining a cusp partially removed by an inlet and an outlet port opening on opposite sides of the housing; helical, meshed, lobed rotors rotatably disposed in the chambers, the lobes having a lead end and a trailing end in their directions of rotation, and the lobes sealingly cooperating with the chamber wall surfaces for transfering volumes of compressible fluid from the inlet port to the outlet port; the method comprising the steps of maximizing the number of rotational degrees the lobes are in sealing cooperation with the cylindrical wall surfaces by skewing the inlet port opening toward the lead ends of the lobes and the outlet port opening toward the trailing ends of the lobes, and by positioning the inlet and outlet port boundaries such that the trailing ends of the lobes traverse the cusp associated with the inlet port during or after traversal of the inlet port boundaries and the lead ends of the lobes traverse the cusp associated with the outlet ports prior to traversal of the outlet port boundaries; and minimizing airborne noise at a specified blower speed and pressure ratio by positioning an elongated backflow port on opposite sides of the outlet port boundaries for complete traversal by the lobes of the associated rotor within a range of 20–40 rotational degrees prior to said cusp traversal and providing said backflow ports with a flow area effective to provide a substantially linear pressure rise of each transfer volume.

BRIEF DESCRIPTION OF THE DRAWINGS

A Roots-type blower intended for use as a supercharger is illustrated in the accompanying drawings in which:

FIG. 2 is a schematic sectional view of the blower looking along line 2—2 of FIG. 1;

FIG. 3 is a bottom view of a portion of the blower looking in the direction of arrow 3 in FIG. 1 and illustrating an inlet port configuration;

FIG. 4 is a top view of a portion of the blower looking in the direction of arrow 4 of FIG. 1 and illustrating an outlet port configuration;

FIG. 5 is a schematic sectional view of the blower looking along line 5—5 of FIG. 4 with the blower rotors in a different position from that of FIG. 2;

FIG. 6 is another view of the outlet port with the rotor lands positioned according to FIG. 5; and FIG. 7 is a sectioned view of the blower housing looking along line 7—7 of FIG. 4 and with the blower rotors removed.

DETAILED DESCRIPTION OF THE DRAWINGS

Figure 1:
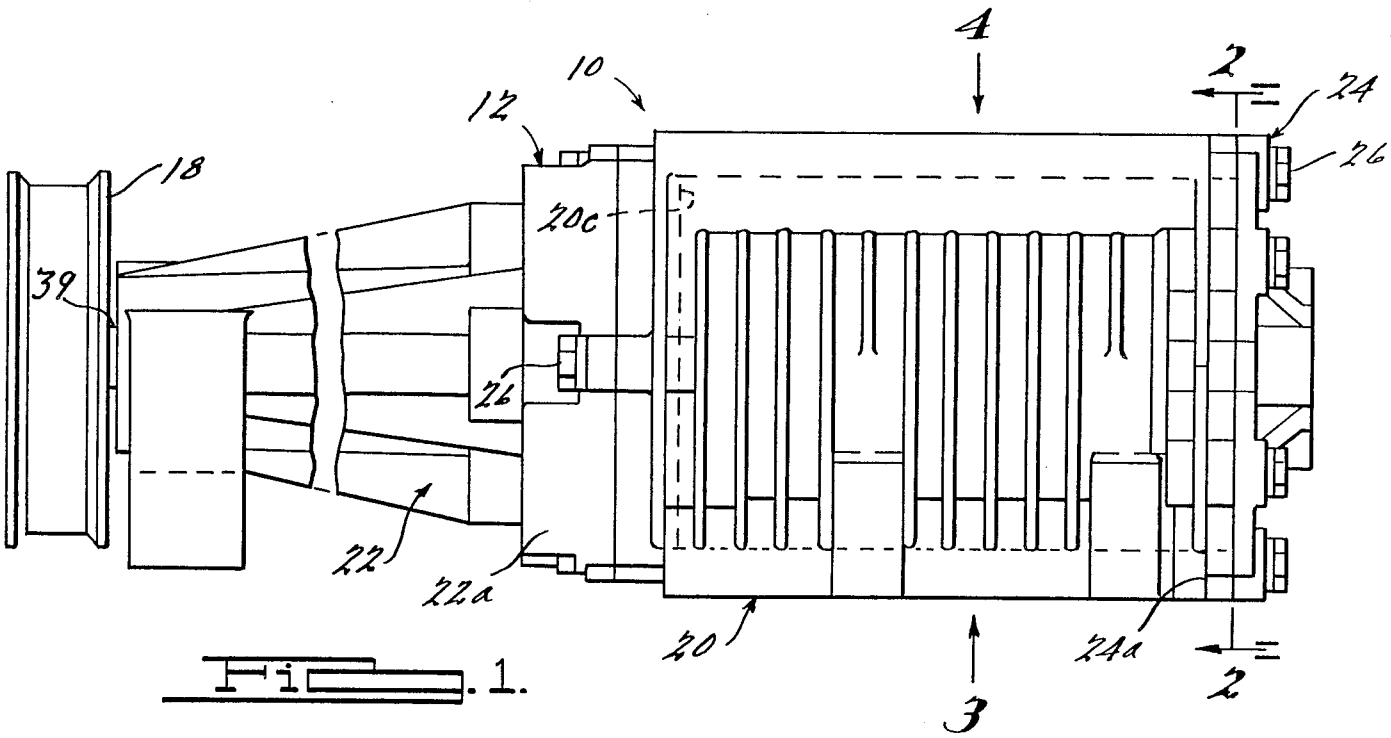
FIG. 1 is a side elevational view of the Roots-type blower.

FIGS. 1-7 illustrate a rotary pump or blower 10 of the Roots-type. As previously mentioned, such blowers are used almost exclusively to pump or transfer volumes of compressible fluid, such as air, from an inlet port to an outlet port without compressing the transfer volumes prior to exposure to the outlet port. The rotors operate somewhat like gear-type pumps, i.e., as the rotor teeth or lobes move out of mesh, air flows into volumes or spaces defined by adjacent lobes on each rotor. The air in the volumes is then trapped therein at substantially inlet pressure when the top lands of the trailing lobe of each transfer volume move into a sealing relation with the cylindrical wall surfaces of the associated chamber. The volumes of air are transferred or directly exposed to outlet air when the top land of the leading lobe of each upcoming volume moves out of sealing relation with the cylindrical wall surfaces by traversing the boundary of the outlet port. If helical lobes are employed, the volume of air may also be indirectly exposed to outlet port air via a transfer volume of the other rotor whose lead lobe has already transversed the outlet port boundary by virtue of the lead end of each helical lobe traversing the cusp defined by the intersection of the cylindrical chamber surfaces and associated with the outlet port. This indirect communication aspect of a Roots-type blower prevents mechanical compression of the transfer volume fluid and distinguishes a Roots-type blower from a conventional screw-type blower. If the volume of each transfer volume remains constant during the trip from inlet to outlet, the air therein remains substantially at inlet pressure, i.e., transfer volume air pressure remains constant if the top land of the leading lobe traverses the outlet port boundary before lead lobe. Hence, if air pressure at the discharge port is greater than inlet port pressure, outlet port air rushes or backflows into the transfer volumes as the top lands of the leading lobes traverse the outlet port boundary.

Blower 10 includes a housing assembly 12, a pair of lobed rotors 14, 16, and an input drive pulley 18. Housing assembly 12, as viewed in FIG. 1, includes a center section 20, and left and right end sections 22, 24 secured to opposite ends of the center section by a plurality of bolts 26. The rotors rotate in opposite directions as shown by the arrows A1, A2 in FIG. 2. The housing assembly and rotors are preferably formed from a lightweight material such as aluminum. The center section and end 24 define a pair of generally cylindrical working chambers 32, 34 circumferentially defined by cylindrical wall portions or surfaces **20*a*, 20*b*, an end wall surface indicated by phantom line 20*c* in FIG. 1, and an end wall surface 24*a*. Openings 36, 38 in the bottom and top of center section 20 respectively define the transverse and longitudinal boundaries of inlet and outlet ports. Chambers 32, 34 transversely overlap or intersect at cusps 20*d*, 20*e* respectively associated with the inlet ports and outlet ports, as seen in FIGS. 2–4**.

Rotors 14, 16 respectively include three circumferentially spaced apart helical teeth or lobes **14*a*, 14*b* 14*c* and 16*a*, 16*b*, 16*c* of modified involute profile with an end-to-end twist of 60°. The lobes or teeth mesh, preferably do not touch, and are maintained in proper registry or phase relation by low backlash timing gears as further discussed hereinafter. The lobes also include top lands 14*d*, 14*e*, 14*f*, and 16*d*, 16*e*, 16*f* defining the radially outer extent of each rotor. The lands or radially outer extent of the lobes move in close sealing noncontacting relation with cylindrical wall surfaces 20*a*, 20*b* and with the root portions of the lobes they are in mesh with. Since the lobes are helical, an end 14*g*, 16*g* of each lobe on each rotor leads the other end 14*h* 16*h* in the direction of rotor rotation. Rotors 14, 16 are respectively mounted for rotation in cylindrical chambers 32, 34 about axes substantially coincident with the longitudinally extending, transversely spaced apart, parallel axes of the cylindrical chambers. Such mountings are well-known in the art. Hence, it should suffice to say that unshown shaft ends extending from and fixed to the rotors are supported by unshown bearings carried by end wall 20*c* and end section 24. Bearings for carrying the shaft ends extending rightwardly into end section 24 are carried by outwardly projecting bosses 24*b*, 24*c*. The rotors may be mounted and timed as shown in U.S. patent application Ser. No. 506,075, filed June 20, 1983 now U.S. Pat. No. 4,638,570 and incorporated herein by reference. Rotor 16 is directly driven by pulley 18 which is fixed to the left end of a shaft 39. Shaft 39 is either connected to or an extension of the shaft end extending from the left end of rotor 16. Rotor 14 is driven in a conventional manner by unshown timing gears fixed to the shaft ends extending from the left ends of the rotors. The timing gears are of the substantially no backlash type and are disposed in a chamber defined by a portion 22*a* of end section 22**.

The rotors, as previously mentioned, have three circumferentially spaced lobes of modified involute profile with an end-to-end helical twist of 60°. Rotors with other than three lobes, with different profiles and with different twist angles, may be used to practice certain aspects or features of the inventions disclosed herein. However, to obtain uniform displacement based on meshing geometry and trapped volumes, the lobes are preferably provided with a helical twist from end-to-end which is substantially equal to the relation 360°/2n, where n equals the number of lobes per rotor. Further, involute profiles are also preferred since such profiles are more readily and accurately formed than most other profiles; this is particularly true for helically twisted lobes. Still further, involute profiles are preferred since they have been more readily and accurately timed during supercharger assembly. Excessive pressure buildup of air trapped between the remeshing lobes may be relieved by the method taught in copending U.S. application Ser. No. 647,074 filed Sept. 4, 1984, now U.S. Pat. No. 4,569,646.

As may be seen in FIG. 2, the rotor lobes and cylindrical wall surfaces sealingly cooperate to define an inlet receiver chamber **36*a*, an outlet receiver chamber 38*a*, and transfer volumes 32*a*, 34*a*. For the rotor positions of FIG. 2, inlet receiver chamber 36*a* is defined by portions of the cylindrical wall surfaces disposed between top lands 14*f*, 16*e* and the mesh of lobes 14*b*, 16*c*. Likewise, outlet receiver chamber 38*a* is defined by portions of the cylindrical wall surfaces disposed between top lands 14*d*, 16*d* and the mesh of lobes 14*b*, 16*c*. The cylindrical wall surfaces defining both the inlet and outlet receiver chambers include those surface portions which were removed to define the inlet and outlet port openings. Transfer volume 32*a* is defined by adjacent lobes 14*a*, 14*c* and the portion of cylindrical wall surfaces 20*a* disposed between top lands 14*d*, 14*f*. Likewise, transfer volume 34*a* is defined by adjacent lobes 16*a*, 16b and the portion of cylindrical wall surface 20*b* disposed between top lands 16*d*, 16*e*. As the rotors turn, transfer volumes 32*a*, 34*a* are reformed between subsequent pairs of adjacent lobes. Each transfer volume includes a leading lobe and a trailing lobe. For transfer volume 32***a*, lobe 14*a* is a leading lobe and lobe 14*c* is a trailing lobe.

Inlet port 36 is provided with a triangular opening by wall surfaces 20*f*, 20*g*, 20*h*, 20*i* defined by housing section 20. Wall surfaces 20*f*, 20*h* define the longitudinal boundaries or extent of the port and wall surfaces 20*g*, 20*i* define the transverse boundaries or extent of the port. Transverse boundaries 20*g*, 20*i* are disposed on opposite sides of an imaginary or unshown plane extending through the longitudinal intersection of the chambers and cusps 20*d*, 20*e*. The transverse boundaries or wall surfaces 20*g*, 20*i* are matched or substantially parallel to the traversing top lands of the associated lobes and the longitudinal boundary 20*f* is disposed substantially at the leading ends 14*g*, 16*g* of the lobes. This arrangement skews the major portion of the inlet port opening toward the lead ends 14*g*, 16*g* of the lobes and their top lands. Further, the transverse boundaries are positioned such that the lands of the associated lobes traverse wall surfaces 20*g*, 20*i* prior to traversing of the unshown plane or cusp 20*d* associated with the inlet port by the trailing ends 14*h*, 16*h* of the lobes. Wall surfaces 20*g*, 20*i* may be spaced further apart than shown herein if additional inlet port area is needed to prevent a pressure drop across the inlet port. Such a pressure drop situation could arise if the rotor rotational speed was increased beyond the 14,000 to 16,000 RPM range contemplated for the blower herein. The top lands of the helically twisted lobes in FIGS. 3, 4, and 6 are schematically illustrated as being diagonally straight for simplicity herein. However, as viewed in these figures, such lands actually have a curvature. Wall surfaces 20*g*, 20*i* may also be curved to more closely conform to the helical twist of the top lands.

Outlet port 38 is provided with a triangular opening by wall surfaces 20*m*, 20*n*, 20*p*, 20*r* defined by housing section 20. Wall surfaces 20*m*, 20*p* define the longitudinal boundaries or extent of the port and wall surfaces 20*n*, 20*r* define the transverse boundaries or extent of the port. Transverse boundaries 20*n*, 20*r* are disposed on opposite sides of the imaginary or unshown plane extending through the longitudinal intersection of the chambers and cusps 20*d*, 20*e*. The transverse boundaries or wall surfaces 20*n*, 20*r* are matched or substantially parallel to the traversing top lands of the associated lobes and the longitudinal boundary 20*m* is disposed substantially at the trailing ends 14*h*, 16*h* of the lobes. This arrangement skews the major portion of the outlet port opening toward the trailing ends 14*h*, 16*h* of the lobes and their top lands. Further, the transverse boundaries 20*n*, 20*r* are positioned such that the lands of the associated lobes traverse wall surfaces 20*n*, 20*r* after the leading ends 14*g* 16*g* of the lobes traverse the unshown plane or cusp 20*e* associated with the outlet port. The area of outlet port 38 may be increased in the manner mentioned above for the inlet port. In general, the longitudinal extent of the inlet and outlet ports may extend substantially the full length of the lobes.

The inlet-outlet arrangement minimizes the time full outlet port air pressure is exposed to the lobes of each upcoming transfer volume and maximizes the seal time of the top lands of each upcoming transfer volume, i.e., the number of rotational degrees the top lands are in sealing relation with the cylindrical wall surfaces between the associated inlet and outlet port boundaries. By way of example and as may be seen in FIG. 7, the distance from cusp 20*d* to cusp 20*e* of housing 20 is 260° and the arc distance from the associated inlet and outlet port boundaries is 225°. Hence, for rotors each having three lobes, circumferentially spaced 120° apart and provided with a 60° twist, the top land of the trailing lobe of each upcoming transfer volume is in apparent sealing relation with the associated, cylindrical wall surfaces for 105°. However, since cusps 20*d*, 20*e* extend parallel to the rotational axes of the rotor, the actual, total seal time is 80° plus top land circumferential width due to late traversal of inlet port cust 20*d* by the trailing ends of the lobes and early traversal of outlet port cust 20*e* by the leading ends of the lobes. For the blower disclosed herein, seal times of about 86° are readily obtainable when the width of the top land is considered. Traversal of outlet port cusp 20*e* by the leading ends of the lobes indirectly communicates the upcoming transfer volumes of one rotor with outlet port air via transfer volumes of the other rotor whose lead lobes have already traversed their associated outlet port boundary. For example, when lead land 16*d* of upcoming transfer volume 34*a* initially traverses outlet port cusp 20*e*, as may be seen in FIG. 4, its associated outlet port boundary 20*n* has not been traversed. Hence, there is no direct communication with outlet port air. However, there is indirect communication via air in receiver chamber 38*a*, i.e., air from a transfer volume of rotor 14. This indirect communication aspect of a Roots-type blower prevents mechanical compression of transfer volume fluid prior to direct or indirect communication with the outlet port, distinguishes a Roots-type blower from a conventional screw-type blower, and is a result of a fundamental difference in the type of lobes employed in the two blowers. The lobes of a Roots-type blower have substantially equal addendum and dedendum, whereas the lobes of a screw compressor are substantially all addendum on one rotor and all dedendum on the other rotor.

The blower, as thus far described, has virtually no airborne noise due to meshing geometry and, compared to Roots-type blowers in general, has a particularly high or superior volumetric efficiency in all RPM ranges of the rotors. However, fluid velocity and pressure fluctuations generates airborne noise due to backflow in and around outlet receiver chamber 38*a*. The noise, which is proportional to the percentage of pressure change in receiver chamber 38*a*, was particularly high at 9,000 RPM and a 1.68 pressure ratio. The percent of pressure change was decreased by approximately a factor of ten by employing elongated backflow slots 40, 42 disposed substantially parallel to the traversing top lands of the associated lobes and positioned for initial traversal 20–40 rotational degrees prior to traversal of outlet port cusp 20*e* by leading ends 14*g*, 16*g* of the lobes. As previously mentioned, the total seal time for each trapped volume trailing lobe top land is 80 degrees with respect to the inlet and outlet port cusps 20*d*, 20*e* or the imaginary plane extending through the cusps. This total seal time becomes 60 to 40 degrees when the backflow slots are positioned 20 to 40 degrees from the outlet port cusp 20*e*. Since backflow slots or ports 40,42 and transverse boundaries 20*u* or 20*r* of the outlet ports are symmetrically disposed about the plane extending through cusps 20*d*, 20*e* and since the lobes of each rotor are spaced the same number of rotational degrees apart, the lead lobe top lands of each rotor alternately traverse the associated backflow ports and the outlet port boundaries x number of rotational degrees apart, wherein x equals (360°/2 times the number of lobes per rotor). Accordingly, x equals 60 rotational degrees when each rotor has three lobes. Backflow slots 40, 42 preferably have a length/width ratio of at least 4 and well rounded entrances 40*a*, 42*a*. Exceptionally good results were obtained with slots having radiused ends, a length of 2.130 inches, a width of 0.232 and a flow area of 0.483 square inches. Slots of this size provide a rapidly opening back flow area which is somewhat restricted even after complete traversal by the top lands. Slots 40, 42 should be sized and spaced from the outlet port boundaries so as to gradually increase the pressure of each upcoming transfer volume to substantially the pressure of the outlet air at the instant the lead lobe of the upcoming transfer volume traverses the outlet port boundaries. Hence, rotor speed and pressure ratio are important when sizing and positioning the slots. Leakage of air between the top lands of trailing lobes is reduced by positioning the slots as close to the outlet port boundaries as practicable and sizing the slots to gradually increase pressure in the upcoming transfer volume. Such slots are believed to reduce the previously mentioned superior volumetric efficiency by less than 1%. Accordingly, the Roots-type blower, as disclosed herein provides both superior volumetric efficiency and quietness without increasing the cost and/or sacrificing reliability of the blower.

The preferred embodiment of the invention has been disclosed herein in detail for illustrative purposes. Many variations of the disclosed embodiment are believed to be within the spirit of the invention. The following claims are intended to cover inventive portions of the disclosed embodiment and modifications believed to be within the spirit of the invention.

What is claimed is:

1. A rotary blower of the backflow type including:

a housing assembly defining two parallel transversely overlapping cylindrical chambers having internal cylindrical and flat end wall surfaces, the axes of the cylindrical chambers defining a longitudinal direction;

an inlet port and an outlet port opening having, with respect to the longitudinal direction, longitudinal and transverse boundaries defined by and on opposite sides of the housing assembly, said transverse boundaries of each port being disposed on opposite sides of a plane extending longitudinally through the overlapping intersection of the chambers;

meshed, lobed rotors rotatably disposed in the chambers, the rotor lobes formed with a helical twist and therefore each having a lead end and a trailing end in the direction of rotor rotation, the ends of the rotors and lobes sealingly cooperating with the end wall surfaces, the lobes of each rotor having top lands extending between the lead and trailing ends, the top lands sealingly cooperating with the cylindrical wall surface of the associated chamber and being operative to traverse the port boundaries disposed on the associated side of the plane for effecting transfer of volumes of compressible inlet port fluid to the outlet port via spaces between adjacent unmeshed lobes of each rotor, and the volume of each transfer volume remaining constant while the top lands of the leading and trailing lobes of each transfer volume are disposed between the associated boundaries of the inlet and outlet ports; the improvement comprising:

rapidly opening backflow port means extending through the housing wall of each cylindrical chamber for effecting a backflow of outlet port fluid into each transfer volume prior to traversal of the outlet port boundaries by the top land of the lead lobe of each transfer volume, said backflow port means positioned for traversal by the lead lobe top land of each transfer volume at least 40 rotational degrees after traversal of the inlet port boundaries by the top land of the trailing lobe of each transfer volume.

2. The rotary blower of claim 1, wherein each rapidly opening backflow port means extends substantially parallel to the traversing top lands.

3. The rotary blower of claim 2, wherein the transverse boundaries of the inlet and outlet ports are disposed substantially parallel to the traversing top lands.

4. The rotary blower of claim 1, wherein the transverse boundaries of the inlet and outlet ports are disposed substantially parallel to the traversing top lands, the backflow port means is a slot extending through the housing wall of each cylindrical chamber and with the length/width ratio of each slot being greater than four and with the lengthwise extent of each backflow slot being substantially parallel to the traversing top lands.

5. A method of reducing airborne noise and improving volumetric efficiency of a Roots-type blower including a housing defining two parallel, longitudinally extending, transversely overlapping, cylindrical chambers having cylindrical and end wall surfaces and having inlet and outlet ports on opposite sides of the housing in the areas where the chambers overlap, the ports each having longitudinal and transverse boundaries respectively defining the longitudinal and transverse extent of the ports; meshed lobed rotors rotatably disposed in the chambers, the lobes having a helical twist and therefore a lead end and a trailing end in the direction of rotor rotation, each lobe having a top land extending between the lead and trailing ends and the top land sealingly cooperating with the cylindrical wall surfaces for transferring volumes of compressible fluid from the inlet port to the outlet port in response to traversal of the port boundaries, and the transverse boundaries of the inlet port being disposed for traversal by the top lands prior to traversal of the plane by the trailing end of the top lands; the method comprising:

maximizing the number of rotational degrees the top lands are in sealing cooperation with the cylindrical wall surfaces by skewing the inlet port opening toward the lead ends of the lobes and the outlet port opening toward the trailing ends of the lobes;

minimizing airborne noise due to backflow of outlet port fluid into the transfer volumes by providing each chamber with rapidly opening backflow port means positioned for traversal by the top land of the lead lobe of each transfer volume at least 40 rotational degrees after the trailing end of the trailing lobe top land traverses the plane and therefore at least substantially 40 rotational degrees after the top land of the trailing lobe of each transfer volume moves into inlet sealing cooperation with the cylindrical wall surfaces of the associated chamber.

6. The method of claim 5, wherein sealing cooperation of the top lands is further maximized by forming the ports with transverse boundaries substantially parallel to the top lands.

7. The method of claim 6, wherein the airborne noise is further minimized by positioning the rapidly opening backflow ports substantially parallel to the transversing top lands.

8. The method of claim 5, wherein the airborne noise is further minimized by the backflow ports being a slot extending through the housing wall of each cylindrical chamber and providing each slot with a length/width ratio greater than four and with the lengthwise extent of each backflow slot being substantially parallel to the traversing top lands.

9. In a rotary blower of the backflow type including:

a housing defining two parallel, transversely overlapping cylindrical chambers having internal cylindrical and end wall surfaces, the axes of the cylindrical chambers defining a longitudinal direction and the end walls defining a transverse direction, and each intersection of the cylindrical wall surfaces defining a cusp extending in the longitudinal direction;

an inlet port and an outlet port having longitudinal and transverse boundaries defined by an opening in opposite sides of the housing with the transverse boundaries of each port disposed on opposite sides of a plane extending longitudinally through the cusps;

meshed, lobed rotors rotatably disposed in the chambers, the ends of the rotors and lobes sealingly cooperating with the end wall surfaces, the lobes of each rotor having top lands sealingly cooperating with the cylindrical wall surfaces of the associated chamber and operative to traverse the port boundaries disposed on the associated side of the plane for effecting transfer of volumes of compressible inlet port fluid to the outlet port via spaces between adjacent unmeshed lobes of each rotor, and the volume of each transfer volume remaining constant while the top lands of the leading and trailing lobes of each transfer volume are disposed between the associated boundaries of the inlet and outlet ports; the improvement comprising:

a backflow port extending completely through a portion of the housing wall of each cylindrical chamber, the backflow ports being transversely spaced from each other on opposite sides of the plane, both backflow ports being on the outlet port side of the housing and both being structurally separated from the inlet and outlet ports by portions of the cylindrical wall surfaces, each backflow port traversed by the top land of the lead lobe of the associated upcoming transfer volume and providing a restricted passage for communicating outlet port fluid to each upcoming transfer volume prior to traversal of the associated outlet port boundaries by the top land of the lead lobe and prior to traversal of the cusp associated with the outlet port side of the housing, and said backflow ports having a length/width ratio greater than four with the lengthwise extent of said backflow ports being substantially parallel to the lengthwise extent of the traversing top lands to facilitate rapid opening of the backflow ports.

10. The rotary blower of claim 9 wherein the lobes of each rotor are formed with a helical twist whereby each land has a lead end and a trailing end in the direction of rotor rotation and whereby the lengthwise direction of each backflow port being oblique to the axes of the cylinders.

11. The rotary blower of claim 10, wherein the leading edge of each backflow port in the direction of rotor rotation of the associated top lands is positioned for traversal 20–40 rotational degrees prior to traversal of the cusp associated with the outlet port.

12. The rotary blower of claim 11, wherein traversal of the cusp associated with the outlet port by the top land at the leading end of the lead lobe of each upcoming transfer volume occurs prior to traversal of the outlet port boundaries and indirectly communicates the upcoming transfer volume with the outlet port via a transfer volume the of other rotor already in direct communication with the outlet port.

13. The rotary blower of claim 11, wherein the top lands of the lead lobes of each rotor alternately traverse the associated backflow ports and outlet port boundaries x number of rotational degrees apart, wherein x equals (360°)/(2 times the number of lobes per rotor), and wherein the outlet port boundaries are such that an upcoming transfer volume of one rotor communicates indirectly with the outlet port via a transfer volume of the other rotor in response to the top land lead end of the lead lobe of the upcoming transfer volume traversing the cusp associated with the outlet port and prior to the top land of the lead lobe of the upcoming transfer volume traversing the associated boundaries of the outlet port.

14. The rotary blower of claim 10, wherein the inlet port opening is skewed toward the leading ends of the lobes, the outlet port opening is skewed toward the trailing ends of the lobes, and said backflow ports are skewed toward the leading ends of the lobes.

15. The rotatry blower of claim 9, wherein the blower is of the Roots type, each rotor has three lobes formed with a 60° helical twist, whereby each top land has a lead end and a trailing end in the direction of rotor rotation, the transverse boundaries of the inlet and outlet ports are disposed substantially parallel to the associated lobes when traversed, and the top land lead end of the lead lobe of each upcoming transfer volume traverses the associated backflow port prior to traversing the cusp associated with the outlet port.

16. The rotary blower of claim 9, wherein the blower is of the Roots type, each rotor has three lobes formed with a 60° helical twist, the transverse boundaries of the inlet and outlet ports are disposed substantially parallel to the associated lobes when traversed, the top land of the trailing lobe of each tansfer volume is in sealing cooperation with its associated cylindrical wall surface for at least 40 rotational degrees before the top land of the leading lobe of each transfer volume traverses the leading edge of the associated backflow port.

17. A method of reducing airborne noise and improving volumetric efficiency of a Roots-type blower including a housings defining two parallel, transversely overlapping, cylindrical chambers having cylindrical and end wall surfaces with each intersection of the cylindrical wall surfaces defining a cusp partially removed by an inlet and an outlet port opening on opposite sides of the housing; helical meshed, lobed rotors rotatably disposed in the chambers, the lobes each having a lead end and a trailing end in their directions of rotation, and the lobes sealingly cooperating with the chamber wall surfaces for transferring volumes of compressible fluid from the inlet port to the outlet port; the method comprising:

maximizing the number of rotational cylindrical wall surfaces by skewing the inlet port opening toward the lead ends of the lobes and the outlet port opening toward the trailing ends of the lobes, and by positioning the inlet and outlet port boundaries such that trailing ends of the lobes traverse the cusp associated with the inlet port after traversal of the inlet port boundaries and the lead ends of the lobes traverse the cusp associated with the outlet port prior to traversal of the outlet boundaries; and minimizing airborne noise at a specified blower speed and pressure ratio by positioning an elongated port on opposite sides of the outlet port boundaries for complete traversal by the lobes of the associated rotor within a range of 20–40 rotational degrees prior to said outlet port cusp traversal and providing said backflow ports with a length/width ratio greater than four and with the lengthwise extent of said backflow ports being substantially parallel to the lengthwise extent of the traversing top lands of the lobes.

18. The method of claim 17, wherein the twist of the rotor lobes is defined by the relation 360°/2n, where n equals the number of lobes per rotor, and providing said backflow ports with a length/width ratio of at least four.

19. The method of claim 18, wherein n equals two or three.

20. A rotary blower of the backflow type including:

a housing assembly defining two parallel, transversely overlapping cylindrical chambers having internal cylindrical and flat end wall surfaces, the axis of the cylindrical chambers defining a longitudinal direction;

an inlet port and an outlet port having, with respect to the longitudinal direction, longitudinal and transverse boundaries defined by and on opposite sides of the housing assembly, said transverse boundaries of each port being disposed on opposite sides of a plane extending longitudinally through the overlapping intersection of the chambers;

meshed, lobed rotors rotatably disposed in the chambers, the ends of the rotors and lobes sealingly cooperating with the end wall surfaces, the lobes of each rotor having top lands sealingly cooperating with the cylindrical wall surface of the associated chamber and operative to transverse the port boundaries disposed on the associated side of the plane for effecting transfer of volumes of compressible inlet port fluid to the outlet port via spaces between adjacent unmeshed lobes of each rotor, and the volume of each transfer volume remaining constant while the top lands of the leading and trailing lobes of each transfer volume are disposed between the associated boundaries of the inlet and outlet ports; the improvement comprising:

a backflow port extending through the housing wall of each cylindrical chamber for effecting a backflow of outlet port fluid into each transfer volume prior to traversal of the outlet port boundaries by the top land of the lead lobe of each transfer volume and after traversal of the inlet port boundaries by the top land of the trailing lobe of each transfer volume, and said backflow ports having a length/width ratio greater than four with the lengthwise extent of said backflow ports being substantially parallel to the lengthwise extent of the traversing top lands to facilitate rapid opening of the backflow ports.

21. A rotary blower of the backflow type including:

a housing assembly defining two parallel, transversely overlapping cylindrical chambers having internal cylindrical and flat end wall surfaces, the axes of the cylindrical chambers defining a longitudinal direction;

an inlet port and an outlet port having, with respect to the longitudinal direction, longitudinal and transverse boundaries defined by and on opposite sides of the housing assembly, said transverse boundaries of each port being disposed on opposite sides of a plane extending longitudinally through the overlapping intersection of the chambers;

meshed, lobed rotors rotatably disposed in the chambers, the rotor lobes formed with a helical twist, the ends of the rotors and lobes sealingly cooperating with the end wall surfaces, the lobes of each rotor having top lands sealingly cooperating with the cylindrical wall surface of the associated chamber and operative to traverse the port boundaries disposed on the associated side of the plane for effecting transfer of volumes of compressible inlet port fluid to the outlet port via spaces between adjacent unmeshed lobes of each rotor, and the volume of each transfer volume remaining constant while the top lands of the leading and trailing lobes of each transfer volume are disposed between the associated boundaries of the inlet and outlet ports; the improvement comprising:

a backflow port extending through the housing wall of each cylindrical chamber for effecting a backflow of outlet port fluid into each transfer volume prior to traversal of the outlet port boundaries by the top land of the lead lobe of each transfer volume and after traversal of the inlet port boundaries by the top land of the trailing lobe of each transfer volume, and said backflow port having a length/width ratio greater than four with the lengthwise extent of said backflow ports being substantially parallel to the lengthwise extent of the traversing top lands to facilitate rapid opening of the backflow ports.

22. The rotary blower of claim 21, wherein the inlet port opening is skewed toward the leading ends of the lobes, the outlet port opening is skewed toward the trailing ends of the lobes, and said backflow ports are skewed toward the leading ends of the lobes.

23. The rotary blower of claim 21, wherein the blower is of the Roots type, each rotor has as least three lobes, the transverse boundaries of the inlet and outlet ports are disposed substantially parallel to the associated lobes when traversed, the top land of the trailing lobe of each transfer volume is in sealing cooperation with its associated cylindrical wall surface for at least 40 rotational degrees before the top land of the leading lobe of each transfer volume traverses the leading edge of the associated backflow port.

* * * * *